US007096546B2

(12) United States Patent
Poirier

(10) Patent No.: US 7,096,546 B2
(45) Date of Patent: Aug. 29, 2006

(54) MULTICOMPARTMENT FUNERAL URN

(76) Inventor: Clement Poirier, 1467, Jacques Lemaistre, Montreal, Quebec (CA) H2M2C3

( * ) Notice: Subject to any disclaimer, the term of this patent is extended or adjusted under 35 U.S.C. 154(b) by 0 days.

(21) Appl. No.: 10/872,243

(22) Filed: Jun. 18, 2004

(65) Prior Publication Data

US 2004/0261236 A1 Dec. 30, 2004

Related U.S. Application Data

(60) Provisional application No. 60/480,675, filed on Jun. 24, 2003.

(51) Int. Cl.
*A61G 17/00* (2006.01)

(52) U.S. Cl. ..... 27/1

(58) Field of Classification Search ..... 27/1; D99/5; 220/23, 87, 523
See application file for complete search history.

(56) References Cited

U.S. PATENT DOCUMENTS 1,233,605 A 7/1917 Ridley
2,009,724 A 7/1935 Bircher
3,167,844 A 2/1965 Bachofner
4,199,848 A 4/1980 Kohnert
4,324,026 A * 4/1982 Craft ..... 27/1
5,029,373 A * 7/1991 Raymond ..... 27/1
5,088,167 A * 2/1992 Rahe ..... 27/1
5,230,127 A 7/1993 Zukowski et al.
5,379,499 A * 1/1995 Jackson ..... 27/1
5,704,103 A * 1/1998 Crowley et al. ..... 27/1
5,815,897 A * 10/1998 Longstreth ..... 27/1
5,832,575 A * 11/1998 Sturino ..... 27/1
6,584,658 B1 * 7/2003 Robinson ..... 27/1
6,735,831 B1 * 5/2004 Greiwe et al. ..... 27/1

OTHER PUBLICATIONS www.theurnstore.com.

* cited by examiner

*Primary Examiner*—William L. Miller

(57) ABSTRACT

A multicompartment funeral urn has an ash compartment and at least one alternate compartment which can be used for putting in accessories such as a book binder that can include a signature registry, a photo album or any such items. A lid closes the ash compartment and can be either hingedly attached to the ash compartment or releasably attached to it.

4 Claims, 3 Drawing Sheets

MULTICOMPARTMENT FUNERAL URN

This application claims priority based on provisional application No. 60/480,675 filed Jun. 24, 2003.

BACKGROUND OF THE INVENTION

1. Field of the Invention

The invention relates generally to funeral urns but more particularly to an urn having separate compartments to store various mementos.

2. Background of the Invention

The increasing popularity of cremation as a way of handling the deceased has transformed the funeral industry which now designs numerous types of small funeral urns in which to store the ashes of the deceased. These urns have developed into ash storage containers of such varied shapes that the word <<urn>> barely applies anymore. Whether the ash containers—which for brevity will be referred to generally as <<urns>>—are kept at home or exposed in public places such as cemetaries or funeral parlors, people are looking for special designs which have some meaning to them. Besides the urn itself, people also like to display certain mementos such as photographs or poems. In fact some of the small cubicles in which an urn is displayed are sometimes filled with mementos.

The prior art does not show any urns having multiple compartments so that the ashes can be in one compartment while another compartment can be used to store a book of photographs or the visitors registry from the funeral parlor. Such an urn would help keep the cubicle clear of objects and would offer some form of protection to the contents.

SUMMARY OF THE INVENTION

The present invention discloses a multicompartment urn which provides compartments for additional mementos. It presents removable elements such as a binding in which to insert a signature registry and a photo album. Optionally, additional compartments can offer storage for small mementos. Although primarily designed for humans, this new type of urn could also be used for the remains of a favorite pet.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

Figure 1:
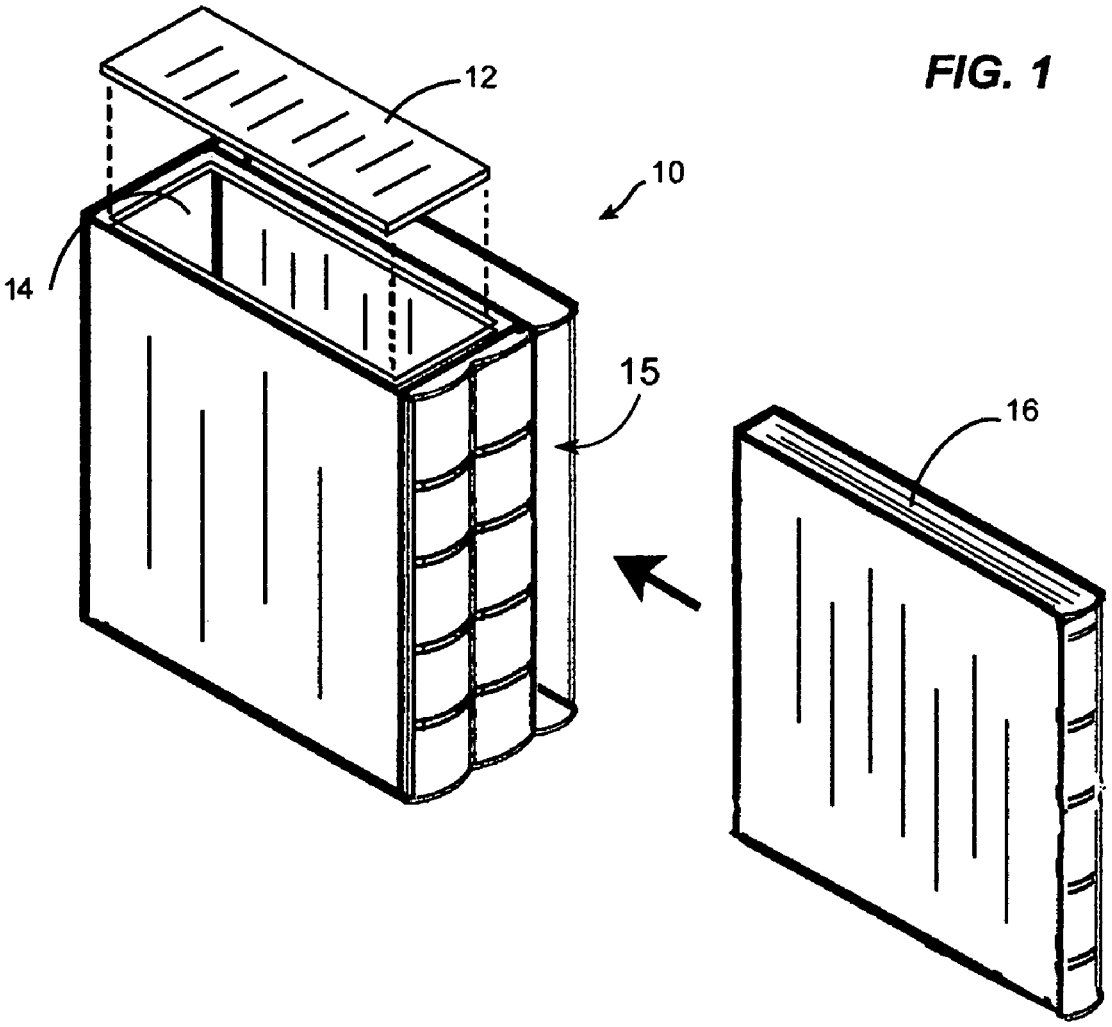

FIG. 1 extended perspective view of the funeral urn.

Figure 2:
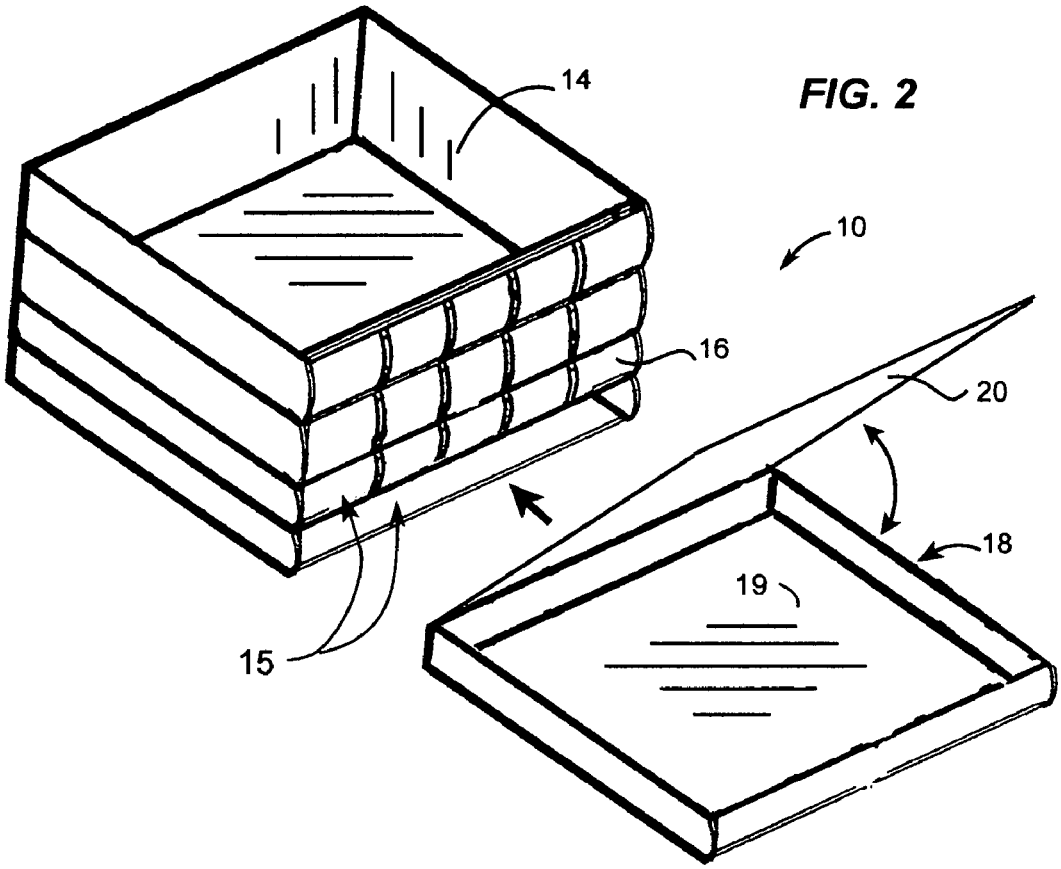

FIG. 2 extended perspective view of an alternate embodiment of the funeral urn.

Figure 3:
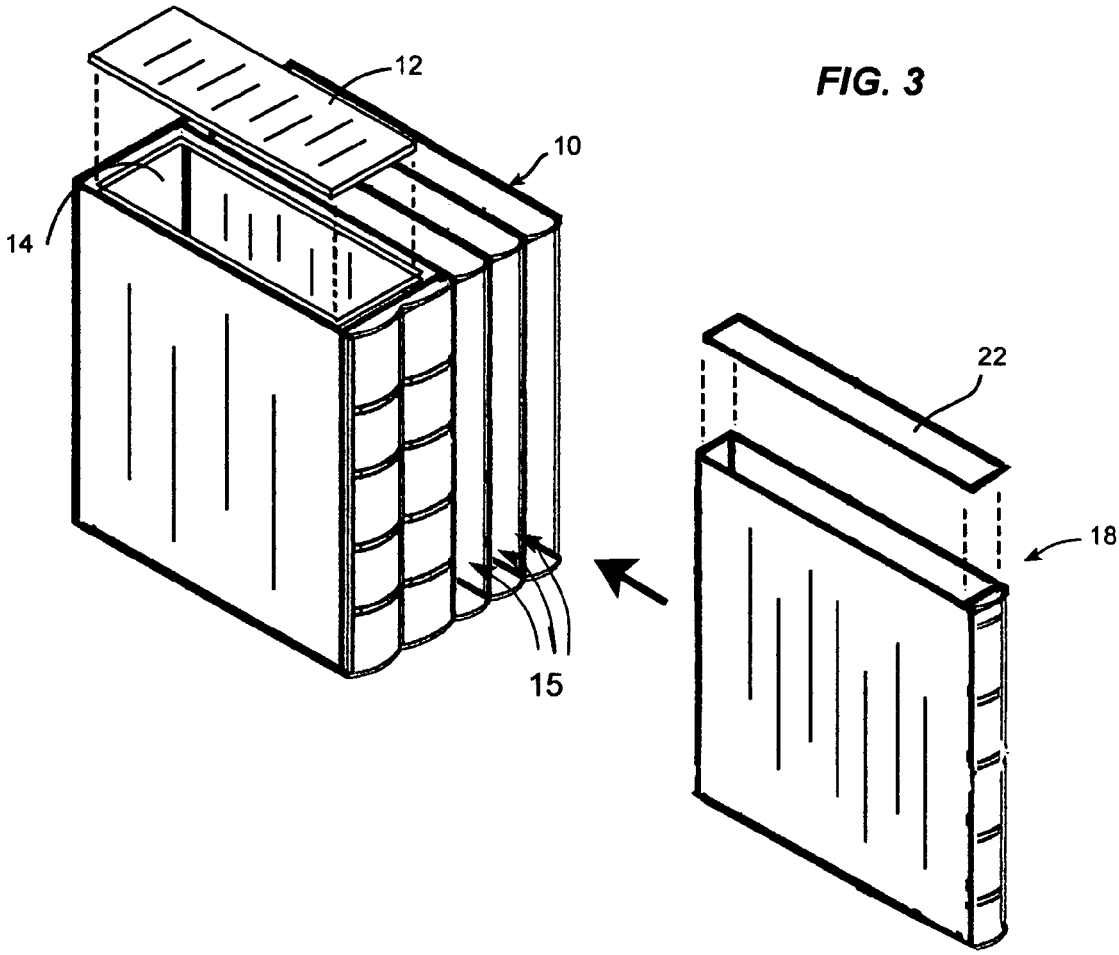

FIG. 3 extended perspective view of a variation to an embodiment of the funeral urn.

DETAILED DESCRIPTION OF THE PREFERRED EMBODIMENT

Referring to FIG. 1, a multicompartment funeral urn (10) has an ash compartment (14) and at least one alternate compartment (15) which can be used for putting in accessories such as a book binder (16) that can include a signature registry, a photo album or any such items. A lid (12) closes the ash compartment (14) and can be either hingedly attached to the ash compartment (14) or releasably attached to it.

FIG. 2 shows an alternate embodiment of the multicompartment funeral urn (10) which is designed to look as if laid flat and with the ash compartment having a larger opening (lid not shown). Here, two alternate compartments (15) are shown where one is a memento box (18) having a container part (19) and a memento box lid (20) and into which personal objects can be put in. Again, the memento box lid (20) can be hingedly attached (as per FIG. 2) or releasably attached. The horizontal configuration could prove more useful for the placement of objects although a vertical box with a lid on the edge (22) as per FIG. 3 could also be possible with multiple alternate compartments (15).

Although a simulated book case look may seem appropriate, other decorative ornaments could be offered, the basic principle being that of a multi-compartment urn. Also, removable lids and flip lids can be used interchangeably without departing from the scope of the invention.

The invention claimed is:

1. A multicompartment funeral urn comprising:

an ash compartment having a lid, said ash compartment for receiving and storing ashes of a deceased;

a first alternate compartment storing a removable book binder;

a second alternate compartment storing a removable memento container, said container having a lid;

said multicompartment funeral urn designed to simulate a book case.

2. A multicompartment funeral urn as in claim 1 wherein: said container lid is hingedly attached to said container.

3. A multicompartment funeral urn as in claim 2 wherein: said ash compartment lid is releasably attached to said ash compartment.

4. A multicompartment funeral urn as in claim 1 wherein: said container lid is releasably attached to said container.

* * * * *